US009937710B2

(12) United States Patent
Zhang

(10) Patent No.: US 9,937,710 B2
(45) Date of Patent: Apr. 10, 2018

(54) LIQUID EJECTING APPARATUS, CONTROL DEVICE, RECORDING SYSTEM, AND PROGRAM

(71) Applicant: SEIKO EPSON CORPORATION, Tokyo (JP)

(72) Inventor: Junhua Zhang, Shiojiri-Shi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/247,139

(22) Filed: Aug. 25, 2016

(65) Prior Publication Data

US 2017/0057218 A1 Mar. 2, 2017

(30) Foreign Application Priority Data

Aug. 27, 2015 (JP) ..... 2015-168280

(51) Int. Cl.

| | |
|---|---|
| ***B41J 2/045*** | (2006.01) |
| ***B41J 2/165*** | (2006.01) |
| *B41J 2/21* | (2006.01) |
| *B41J 19/14* | (2006.01) |

(52) U.S. Cl.

CPC ..... *B41J 2/0451* (2013.01); *B41J 2/04541* (2013.01); *B41J 2/04581* (2013.01); *B41J 2/04588* (2013.01); *B41J 2/16579* (2013.01); *B41J 2/2142* (2013.01); *B41J 2/2139* (2013.01); *B41J 19/142* (2013.01)

(58) Field of Classification Search

CPC .... B41J 2/2142; B41J 29/393; B41J 2/14274; B41J 2002/14354; B41J 2/165; B41J 2/0451; B41J 2/125; B41J 2/2139; B41J 2/04551; B41J 2/04581; B41J 2/04593

See application file for complete search history.

(56) References Cited

U.S. PATENT DOCUMENTS

| | | | | |
|---|---|---|---|---|
| 5,500,657 A * | 3/1996 | Yauchi | B41J 2/0451 | 347/9 |
| 5,627,571 A * | 5/1997 | Anderson | B41J 2/125 | 347/19 |
| 6,168,261 B1 * | 1/2001 | Miyake | B41J 2/2139 | 347/40 |
| 6,270,187 B1 * | 8/2001 | Murcia | B41J 2/0451 | 347/37 |

(Continued)

FOREIGN PATENT DOCUMENTS

| | | |
|---|---|---|
| EP | 1 600 294 A1 | 11/2005 |
| JP | 3794431 B2 | 7/2006 |
| JP | 2009-172966 A | 8/2009 |

*Primary Examiner* — Thinh H Nguyen

(74) *Attorney, Agent, or Firm* — Foley & Lardner LLP

(57) ABSTRACT

A liquid ejecting apparatus includes a liquid ejecting head that is provided with a plurality of nozzle openings that discharge a liquid, and pressure generation units that generate pressure changes in pressure generation chambers that are respectively in communication with the nozzle openings, a detection unit that detects a discharge fault of liquid droplets of the liquid ejecting head for each of the nozzle openings, and a control unit that controls the pressure generation units, in which the control unit has a discharge prohibition mode in which the driving of a pressure generation unit that corresponds to a nozzle opening in which a discharge fault is detected, is prohibited after the corresponding discharge fault is detected while recording is underway.

10 Claims, 6 Drawing Sheets

(56) References Cited

U.S. PATENT DOCUMENTS

| | | | | |
|---|---|---|---|---|
| 6,293,645 | B1 * | 9/2001 | Kim | B41J 2/16579 347/19 |
| 7,407,264 | B2 * | 8/2008 | Kuwahara | B41J 2/04505 347/14 |
| 7,690,744 | B2 * | 4/2010 | Nakanishi | B41J 2/2139 347/12 |
| 9,555,622 | B2 * | 1/2017 | Yanagisawa | B41J 2/0451 |

* cited by examiner

LIQUID EJECTING APPARATUS, CONTROL DEVICE, RECORDING SYSTEM, AND PROGRAM

BACKGROUND

1. Technical Field

The present invention relates to a liquid ejecting apparatus that is provided with a liquid ejecting head, which discharges a liquid from a nozzle opening, a control device which can be connected to a liquid ejecting apparatus, a recording system that is provided with a control device, and a program for controlling a control device.

2. Related Art

Examples of a liquid ejecting apparatus that is provided with a liquid ejecting head, which discharges a liquid, include an ink jet type recording apparatus that generates pressure inside a pressure generation chamber using a pressure generation unit, and is provided with an ink jet type recording head, which discharges ink droplets from a nozzle that is in communication with the pressure generation chamber.

In an ink jet type recording head that is installed in such an ink jet type recording apparatus, there are cases in which a discharge fault of ink droplets is generated, a flushing operation, a cleaning operation, or the like, for preventing discharge faults is performed, and techniques that detect faulty printing have been disclosed.

Furthermore, a technique that completes printing by correcting image data without postponing printing in a case in which a faulty discharge nozzle occurs during printing and an image fault occurs, has been proposed (for example, refer to JP-A-2009-172966).

In this instance, an ink jet type recording head in which a nozzle plate, in which a nozzle opening is provided, and a flow channel formation substrate, in which a pressure generation chamber that is in communication with the nozzle opening is provided, are bonded using an adhesive agent, or the like, has been proposed as an ink jet type recording head that uses a piezoelectric actuator (for example, refer to JP-A-2009-172966).

However, in a case in which a discharge fault such as dot omission occurs, when printing continues after the discharge fault, there is a problem in that it is no longer possible to restore the discharge fault with cleaning, or the like. It is thought that the reason for this is that ink becomes hardened as a result of continuation of a state of being heated on a hot platen after the discharge fault, and restoration becomes no longer possible.

In particular, in a case in which ink having a high viscosity, pigment ink, latex ink that contains water-soluble polymer, ultraviolet ray curable ink, or the like, is used, there is a high probability that a discharge fault from which restoration is not possible, will occur.

Additionally, this kind of problem is not limited to ink jet type recording apparatuses, and the same also applies to liquid ejecting apparatuses that eject liquids other than ink. Furthermore, the same also applies to recording systems that perform recording in a state in which a control device (a host device) and a recording apparatus (a printer) are connected in a wired or wireless manner.

SUMMARY

An advantage of some aspects of the invention is to provide a liquid ejecting apparatus, a recording system and a program that can prevent worsening of discharge faults without stopping ejection of liquid droplets onto an ejection target medium.

According to an aspect of the invention, there is provided a liquid ejecting apparatus including a liquid ejecting head that is provided with a plurality of nozzle openings that discharge a liquid, and pressure generation units that generate pressure changes in pressure generation chambers that are respectively in communication with the nozzle openings, a detection unit that detects a discharge fault of liquid droplets of the liquid ejecting head for each of the nozzle openings, and a control unit that controls the pressure generation units, in which the control unit has a discharge prohibition mode in which the driving of a pressure generation unit that corresponds to a nozzle opening in which a discharge fault is detected, is prohibited after the corresponding discharge fault is detected while recording is underway.

In this case, in a case in which a discharge fault is detected while printing is underway, since driving of the pressure generation unit that corresponds to the nozzle opening of the discharge fault is prohibited without exception, it is possible to reliably restore a nozzle opening in which a discharge fault has occurred using a predetermined restoration process while preventing a circumstance in which the discharge fault is worsened further.

In this instance, it is preferable that the control unit continues recording using nozzle openings other than a nozzle opening in which the discharge fault is detected in the discharge prohibition mode. In this case, it is possible to avoid interruption while printing is underway, and it is possible to reliably restore a nozzle opening in which a discharge fault has occurred using a predetermined restoration process while preventing a circumstance in which the discharge fault is worsened further.

In addition, it is preferable that the control unit continues recording using recording data in which discharge from a nozzle opening in which the discharge fault is detected is supplemented by discharge from another nozzle opening when recording is continued using nozzle openings other than a nozzle opening in which the discharge fault is detected in the discharge prohibition mode. In this case, it is possible to prevent a reduction in printing quality even if a discharge fault occurs.

In addition, it is preferable that the detection unit detects an excessive voltage that is generated in the pressure generation units after the pressure generation units are driven, and detects a discharge fault using a vibration state of the pressure generation units. In this case, it is possible to detect a discharge fault substantially simultaneously with printing.

According to another aspect of the invention, there is provided a control device that can be connected to a liquid ejecting apparatus including a liquid ejecting head that is provided with a plurality of nozzle openings that discharge a liquid, and pressure generation units that generate pressure changes in pressure generation chambers that are respectively in communication with the nozzle openings, the control device including a control section that transmits a control command that includes information that causes the liquid ejecting apparatus to execute recording, in which the control section detects a discharge fault of liquid droplets of the liquid ejecting head of the liquid ejecting apparatus for each of the nozzle openings, and has a discharge prohibition mode in which subsequent driving of a pressure generation unit that corresponds to a nozzle opening in which a discharge fault is detected, is prohibited when the corresponding discharge fault is detected while recording is underway.

In this case, in a case in which a discharge fault is detected while printing is underway, since control is performed so that driving of the pressure generation unit that corresponds to the nozzle opening of the discharge fault is prohibited without exception, it is possible to reliably restore a nozzle opening in which a discharge fault has occurred using a predetermined restoration process while preventing a circumstance in which the discharge fault is worsened further.

In this instance, it is preferable that the control section continues recording using nozzle openings other than a nozzle opening in which the discharge fault is detected in the discharge prohibition mode. In this case, it is possible to avoid interruption while printing is underway, and it is possible to reliably restore a nozzle opening in which a discharge fault has occurred using a predetermined restoration process while preventing a circumstance in which the discharge fault is worsened further.

In addition, it is preferable that the control section continues recording using recording data in which discharge from a nozzle opening in which the discharge fault is detected is supplemented by discharge from another nozzle opening when recording is continued using nozzle openings other than a nozzle opening in which the discharge fault is detected in the discharge prohibition mode. In this case, it is possible to prevent a reduction in printing quality even if a discharge fault occurs.

In addition, it is preferable that the detection of a discharge fault is performed by detecting an excessive voltage that is generated in the pressure generation units after the pressure generation units are driven, and using a vibration state of the pressure generation units. In this case, it is possible to detect a discharge fault substantially simultaneously with printing.

According to still another aspect of the invention, there is provided a recording system including the above-mentioned control device and a liquid ejecting apparatus that can be connected to the control device, and includes a liquid ejecting head provided with a plurality of nozzle openings that discharge a liquid, and pressure generation units that generate pressure changes in pressure generation chambers that are respectively in communication with the nozzle openings.

In this case, in a case in which a discharge fault is detected while printing is underway, since the liquid ejecting apparatus is controlled so that driving of the pressure generation unit that corresponds to the nozzle opening of the discharge fault is prohibited without exception, it is possible to reliably restore a nozzle opening in which a discharge fault has occurred using a predetermined restoration process while preventing a circumstance in which the discharge fault is worsened further.

According to still another aspect of the invention, there is provided a program that is executed by a control section, which controls a control device that can be connected to a liquid ejecting apparatus including a liquid ejecting head that is provided with a plurality of nozzle openings that discharge a liquid, and pressure generation units that generate pressure changes in pressure generation chambers that are respectively in communication with the nozzle openings, the program causing the control section to detect a discharge fault of liquid droplets of the liquid ejecting head of the liquid ejecting apparatus for each of the nozzle openings, and execute a discharge prohibition mode in which subsequent driving of a pressure generation unit that generates a pressure change in a pressure generation chamber, which is in communication with a nozzle opening in which a discharge fault is detected, is prohibited when the corresponding discharge fault is detected while recording is underway.

In this case, in a case in which a discharge fault is detected while printing is underway, since it is possible to cause the control device to function so that driving of the pressure generation unit that corresponds to the nozzle opening of the discharge fault is prohibited without exception, it is possible to reliably restore a nozzle opening in which a discharge fault has occurred using a predetermined restoration process while preventing a circumstance in which the discharge fault is worsened further.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described on the basis of Embodiments.

Embodiment 1

Figure 1:
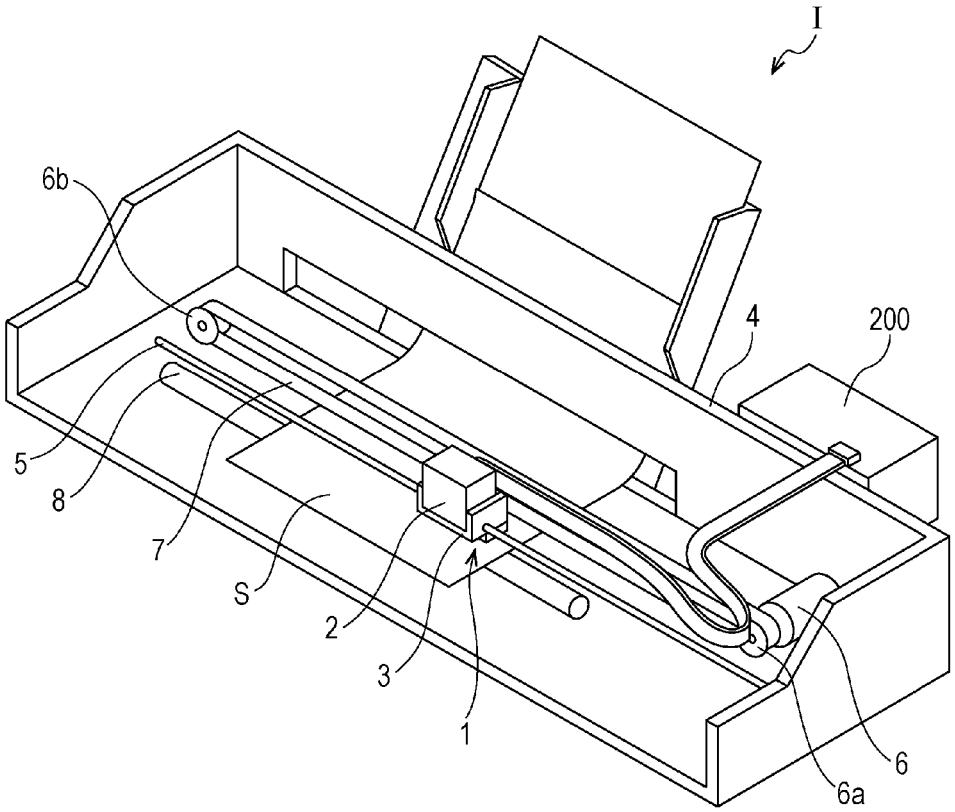
FIG. 1 is a schematic perspective view of a recording apparatus according to Embodiment 1 of the invention.

FIG. 1 is a schematic perspective view of an ink jet type recording apparatus, which is an example of a liquid ejecting apparatus according to an embodiment of the invention.

For example, the liquid ejecting apparatus of the present embodiment is an ink jet type recording apparatus, and as shown in FIG. 1, an ink cartridge 2 that configures an ink supply unit is provided in a recording head unit 1, which includes an ink jet type recording head that will be described later, in an attachable and detachable manner, and a carriage 3 onto which the recording head unit 1 is mounted, is provided on a carriage shaft 5, which is attached to an apparatus main body 4 in a manner in which the carriage 3 is freely movable in an axial direction. The recording head unit 1 discharges a black ink composition and a color ink composition.

In addition, a driving motor 6 is provided in the vicinity of one end of the carriage shaft 5, and a first pulley 6*a*, which includes a groove on the outer periphery thereof, is provided in a tip end portion of the shaft of the driving motor 6. Furthermore, a second pulley 6*b* is provided in a freely rotatable manner in the vicinity of the other end portion of the carriage shaft 5 so as to correspond to the first pulley 6*a* of the driving motor 6, and a timing belt 7 that is formed from an elastic member such as rubber is hung between the first pulley 6*a* and the second pulley 6*b* in an annular shape.

Further, the carriage 3, in which the recording head unit 1 is mounted, is moved along the carriage shaft 5 as a result of the driving force of the driving motor 6 being transmitted to the carriage 3 via the timing belt 7. Meanwhile, a transport roller 8 is provided as a transport unit, and recording sheets S, which are a recording medium such as a paper, are transported by the transport roller 8. Additionally, the transport unit that transports the recording sheets S is not limited to a transport roller, and may be a belt, a drum or the like.

Figure 2:
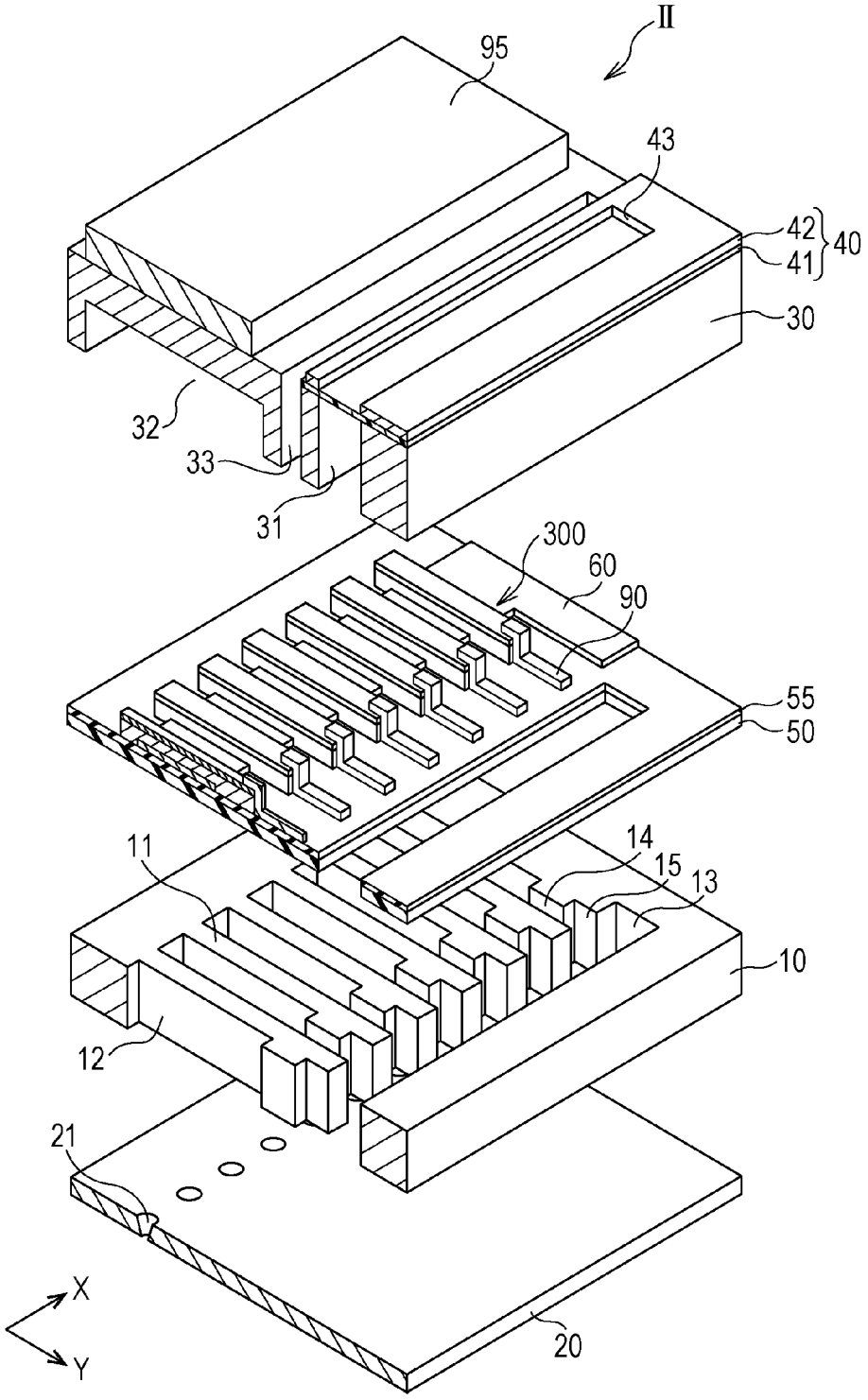
FIG. 2 is an exploded perspective view of a recording head according to Embodiment 1 of the invention.
Figure 3:
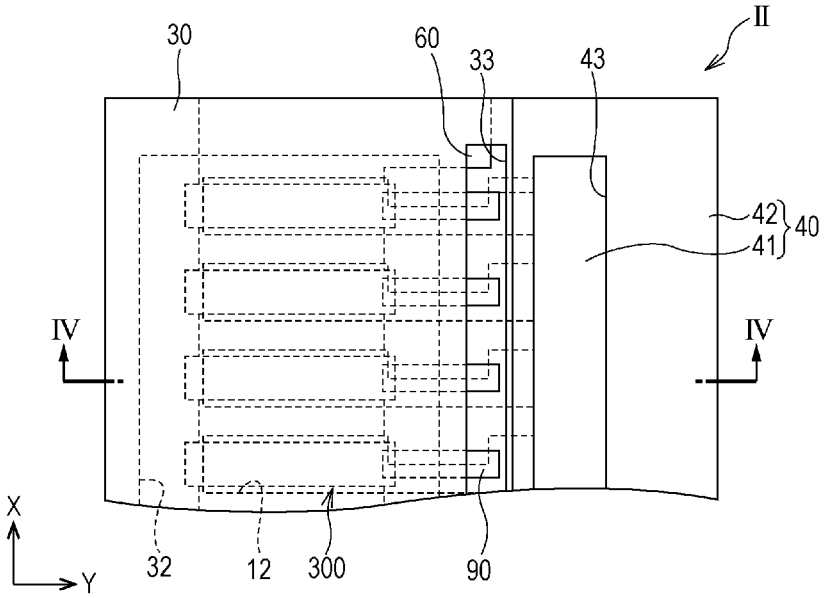
FIG. 3 is a plan view of the recording head according to Embodiment 1 of the invention.
Figure 4:
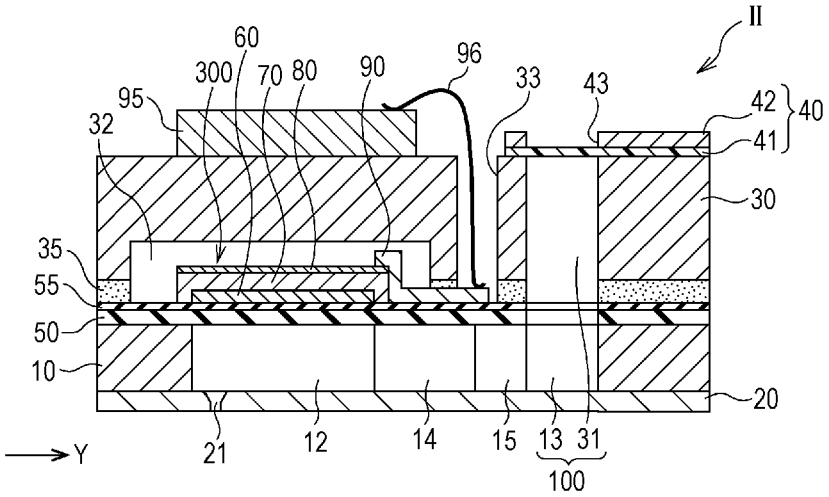
FIG. 4 is a cross-sectional view of the recording head according to Embodiment 1 of the invention.

An ink jet type recording head that is mounted in such an ink jet type recording apparatus will be described. Additionally, FIG. 2 is an exploded perspective view of an ink jet type recording head, which is an example of a liquid ejecting head according to Embodiment 1 of the invention, FIG. 3 is a plan view of the ink jet type recording head, and FIG. 4 is a cross-sectional view along a line IV-IV in FIG. 3.

As is illustrated in the drawings, pressure generation chambers 12 are formed in a flow channel formation substrate 10 that an ink jet type recording head II, which is an example of a liquid ejecting head of the present embodiment, is provided with. Further, the pressure generation chambers 12, which are partitioned by a plurality of dividing walls 11, are arranged in parallel along a direction in which a plurality of nozzle openings 21, which discharge ink of the same color, are arranged in parallel. Hereinafter, this direction will be referred to as a parallel arrangement direction of the pressure generation chambers 12 or as a first direction X. In addition, hereinafter, a direction that is orthogonal to the first direction X will be referred to as a second direction Y.

In addition, ink supply paths 14 and communication paths 15 are partitioned by the plurality of dividing walls 11 on one end portion side of the flow channel formation substrate 10 in a longitudinal direction of the pressure generation chambers 12, that is, on one end portion side in the second direction Y, which is orthogonal to the first direction X. A communication section 13 that configures a portion of a manifold 100, which corresponds to an ink chamber (liquid chamber) that is common to each pressure generation chamber 12, is formed on an outer side of the communication path 15 (on a side that is opposite to the pressure generation chambers 12 in the second direction Y). That is, a liquid flow channel that is formed from the pressure generation chambers 12, the ink supply paths 14, the communication paths 15 and the communication section 13 is provided in the flow channel formation substrate 10.

A nozzle plate 20, in which the nozzle openings 21 that are in communication with each pressure generation chamber 12, are machined, is bonded to one surface side of the flow channel formation substrate 10, that is, a surface on which the liquid flow channel of the pressure generation chambers 12, and the like, is open, using an adhesive agent, a heat welding film, or the like. That is, the nozzle openings 21 are arranged in parallel on the nozzle plate 20 in the first direction X.

An elastic film 50 and an insulating body film 55, which is formed on the elastic film 50, are laminated onto the other surface side of the flow channel formation substrate 10. Additionally, the liquid flow channel of the pressure generation chambers 12 and the like, is formed by performing anisotropic etching of the flow channel formation substrate 10 from one surface, and the other surface of the liquid flow channel of the pressure generation chambers 12 and the like, us configured by the elastic film 50.

Piezoelectric actuators 300 (pressure generation units), which include a first electrode 60, a piezoelectric body layer 70 and a second electrode 80, are formed on the insulating body film 55. In this instance, the piezoelectric actuators 300 refer to portions that include the first electrode 60, the piezoelectric body layer 70 and the second electrode 80. Generally, either one of the electrodes of the piezoelectric actuator 300 is set as a common electrode, and the other electrode and the piezoelectric body layer 70 are configured through patterning for each pressure generation chamber 12. Further, in this instance, portions that are configured by either one of the electrodes and the piezoelectric body layer 70, which are patterned, and in which piezoelectric strain is generated as a result of the application of a voltage to the two electrodes, are referred to as piezoelectric body active sections. In the present embodiment, the first electrode 60 is set as the common electrode of the piezoelectric actuator 300, and the second electrode 80 is set as an individual electrode of the piezoelectric actuator 300, but the it is not a problem if this configuration is reversed for the convenience of a driving circuit, wiring, or the like. Additionally, in the above-mentioned example, the elastic film 50, the insulating body film 55 and the first electrode 60 act as a vibration plate, but naturally, the invention is not limited to this configuration, and for example, instead of the elastic film 50 and the insulating body film 55 being provided, the first electrode 60 alone may function as a vibration plate. In addition, the piezoelectric actuator 300 itself may also have a function of a vibration plate in a practical sense. However, in a case in which the first electrode 60 is provided directly on the flow channel formation substrate 10, it is preferable that the first electrode 60 is protected with a protective film or the like so that the first electrode 60 and ink do not come into contact electrically.

The piezoelectric body layer 70 is a piezoelectric material of an oxide that has a polarization structure, which is formed on the first electrode 60, can, for example, be formed from a perovskite type oxide typically represented by $ABO_3$, the A can include lead, and the B can include at least one of zirconium and titanium. For example, B can also include niobium. More specifically, for example, it is possible to use lead zirconate titanate (Pb (Zr, Ti) $O_3$: PZT), lead zirconate titanate niobate that includes silicon (Pb (Zr, Ti, Nb) $O_3$: PZTNS), or the like, as the piezoelectric body layer 70.

In addition, the piezoelectric body layer 70 may be a non-lead-based piezoelectric material that does not include lead, and for example, may be a composite oxide having a perovskite structure that includes bismuth ferrite or bismuth manganese ferrite, and barium titanate bismuth potassium titanate.

Furthermore, lead electrodes 90 that, for example, are formed from gold (Au) or the like, are drawn out from the vicinity of an end portion of an ink supply path 14 side and are disposed extending onto the insulating body film 55, are connected to each second electrode 80, which are individual electrodes of the piezoelectric actuators 300.

A protective substrate 30 that includes a manifold section 31, which configures at least a portion of the manifold 100, is bonded onto the flow channel formation substrate 10 on which the piezoelectric actuators 300 are formed, that is, onto the first electrode 60, the insulating body film 55, and the lead electrodes 90 using an adhesive 35. The manifold section 31 is formed across the entire width direction of the pressure generation chambers 12 by penetrating the protective substrate 30 in a thickness direction thereof, and configures the manifold 100 that corresponds to the ink chamber that is common to each of the pressure generation chambers 12 as a result of being in communication with the communication section 13 of the flow channel formation substrate 10 in the manner described above. In addition, a configuration in which only the manifold section 31 is used as the manifold may be used by dividing the communication section 13 of the flow channel formation substrate 10 into a plurality of sections for each pressure generation chamber 12. Furthermore, for example, a configuration in which only the pressure generation chambers 12 are provided in flow channel formation substrate 10, and the ink supply paths 14, which are in communication with the manifold and each pressure generation chamber 12, are provided in a member (for example, the elastic film 50, the insulating body film 55, or the like) interposed between the flow channel formation substrate 10 and the protective substrate 30, may also be used.

A piezoelectric actuator retention section 32 that includes a space that is of an extent at which motion of the piezoelectric actuators 300 is not inhibited, is provided in the protective substrate 30 in a region that faces the piezoelectric actuators 300. It is sufficient as long as the piezoelectric actuator retention section 32 has a space that is of an extent at which the motion of the piezoelectric actuators 300 is not inhibited, and the space may be sealed or may not be sealed.

In addition, a through hole 33 that penetrates the protective substrate 30 in the thickness direction is formed in the protective substrate 30. Further, the vicinities of end portions of the lead electrodes 90 that are drawn out from each piezoelectric element 300 are provided so as to be exposed inside the through hole 33.

In addition, a driving circuit 95 that functions as a signal processing section, is fixed onto the protective substrate 30. For example, it is possible to use a circuit board, a semiconductor integrated circuit (IC) or the like as the driving circuit 95. Further, the driving circuit 95 and the lead electrodes 90 are electrically connected via connection wiring 96 that is formed from conductive wire such as bonding wire, which is inserted through the through hole 33.

It is preferable that a material having substantially the same thermal expansion coefficient as that of the flow channel formation substrate 10, such as glass or a ceramic material, is used as the protective substrate 30, and in the present embodiment, the protective substrate 30 is formed using the same material as the flow channel formation substrate 10, which is a monocrystalline silicon substrate having (110) surface orientation.

In addition, a compliance substrate 40 that is formed from a sealing film 41 and a fixing plate 42 is bonded onto the protective substrate 30. In this instance, the sealing film 41 is formed from a flexible material having low rigidity, for example, a polyphenylene sulfide (PPS) film, and one surface of the manifold section 31 is sealed using the sealing film 41. In addition, the fixing plate 42 is formed using a hard material, for example, stainless steel (SUS). Since a region of the fixing plate 42 that faces the manifold 100 is an open portion 43 formed through complete removal in the thickness direction, the surface of the manifold 100 is sealed by the flexible sealing film 41 only.

In the ink jet type recording head II such as that of the present embodiment, ink is taken in from an ink introduction port, which is connected to an external ink supply unit that is not illustrated in the drawings, the inside from the manifold 100 to the nozzle openings 21 is filled with ink, subsequently, a voltage is respectively applied between the first electrode 60 and the second electrodes 80, which correspond to the pressure generation chambers 12 in accordance with a recording signal from the driving circuit 95, the pressure in each pressure generation chamber 12 increases due to the elastic film 50, the insulating body film 55, the first electrode 60 and the piezoelectric body layer 70 being warped and deformed, and ink droplets are discharged from the nozzle openings 21 as a result.

Further, in the present embodiment, it is possible to realize an ink jet type recording head II having high durability and high reliability by using the ink jet type recording head II, which includes the piezoelectric actuator 300 that have the piezoelectric body layer 70 in which fractures such as cracks are even suppressed during repeated driving.

Figure 5:
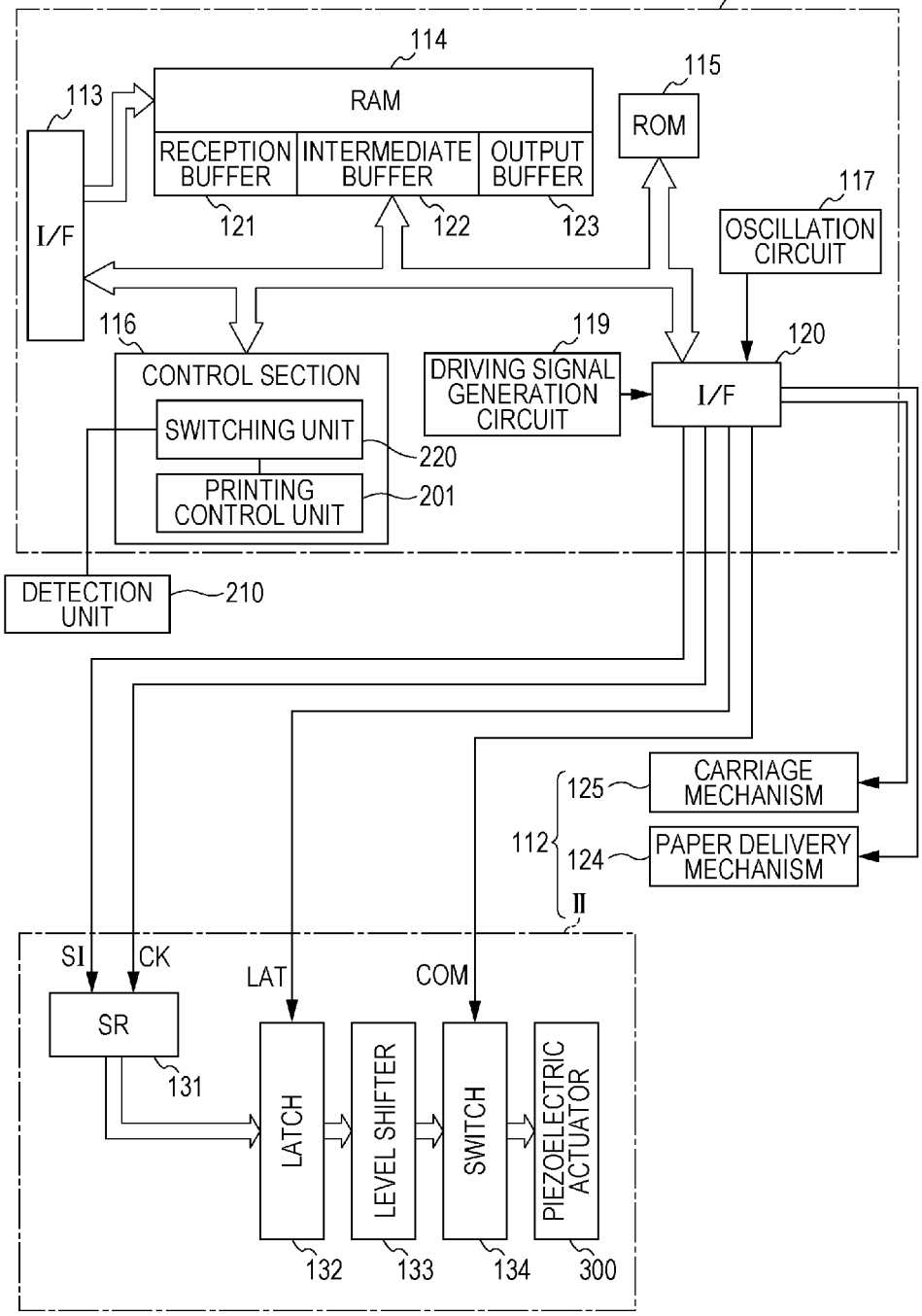
FIG. 5 is a block diagram that shows a control configuration of the recording apparatus according to Embodiment 1 of the invention.

FIG. 5 is a block diagram that shows a control configuration of an ink jet type recording apparatus. In this instance, the control of an ink jet type recording apparatus of the present embodiment will be described with reference to FIG. 5. As shown in FIG. 5, the ink jet type recording apparatus of the present embodiment is schematically configured from a printer controller 111, and a print engine 112. The printer controller 111 is provided with an external interface 113 (hereinafter, referred to an external I/F 113), a RAM 114 that temporarily stores various data, a ROM 115 in which control programs, and the like are stored, a control section 116 that is configured to include a CPU and the like, an oscillation circuit 117 that generates a clock signal, a driving signal generation circuit 119 that generates a driving signal for supply to a liquid ejecting head II, and an internal interface 120 (hereinafter, referred to as an internal I/F 120) that transmits dot pattern data (bitmap data), or the like, that is developed on the basis of a driving signal or printing data, to the print engine 112.

For example, the external I/F 113 receives printing data, which is configured by character codes, graphic functions, image data, and the like, from a host computer, or the like, which is not illustrated in the drawings. In addition, a busy signal (BUSY) and an acknowledgment signal (ACK) are output to the host computer through the external I/F 113. The RAM 114 functions as a reception buffer 121, an intermediate buffer 122, an output buffer 123 and working memory, which is not illustrated in the drawings. Further, the reception buffer 121 temporarily stores printing data that is received by the external I/F 113, the intermediate buffer 122 stores intermediate code data that the control section 116 converts, and the output buffer 123 stores dot pattern data. Additionally, the dot pattern data is configured by print character data that is obtained by decoding (translating) tone data.

In addition, in addition to control programs (control routines) for performing various data processes, font data, graphic functions, and the like are stored in the ROM 115. The control section 116 reads printing data in the reception buffer 121, and stores intermediate code data obtained by converting the printing data, in the intermediate buffer 122. In addition, the control section 116 analyzes intermediate code data that is read from the intermediate buffer 122, and develops the intermediate code data into dot pattern data by referring to font data, graphic functions, and the like that are stored in the ROM 115. Further, after carrying out required decorative processes, the control section 116 stores the developed dot pattern data in the output buffer 123.

Further, once dot pattern data that corresponds to an amount that is equivalent to a single row of the ink jet type recording head II is obtained, the dot pattern data of an amount that is equivalent to a single row is output to the piezoelectric actuator 300 through the internal I/F 120. In addition, when the dot pattern data of an amount that is equivalent to a single row is output from the output buffer 123, the developed intermediate code data is erased from the intermediate buffer 122, and the development process is performed for the next item of intermediate code data.

The print engine 112 is configured to include the ink jet type recording head II, a paper feeding mechanism 124, and a carriage movement mechanism 125. The paper feeding mechanism 124 is configured from a transport motor, the transport roller 8, and the like, and sequentially delivers a printing storage medium such as recording paper, by operating a recording operation of the ink jet type recording head II. That is, the paper feeding mechanism 124 moves a printing storage medium relatively in a sub-scanning direction.

The carriage movement mechanism 125 is configured from the carriage shaft 5 to which the ink jet type recording head II can be mounted, and a carriage driving section that causes the carriage shaft 5 to travel along a main scanning direction, and the ink jet type recording head II is moved in the main scanning direction as a result of causing the carriage shaft 5 to travel. Additionally, the carriage driving section is configured by the above-mentioned driving motor 6, timing belt 7, and the like.

The ink jet type recording head II includes a multitude of the nozzle openings 21 along the sub-scanning direction, and discharges liquid droplets from each nozzle opening 21 at a timing that is stipulated by the dot pattern data, and the like. Further, electric signals, for example, a driving signal (COM), print character data (SI), and the like, which will be described later, are supplied to the piezoelectric actuators 300 of such an ink jet type recording head II via external wiring, which is not illustrated in the drawings. Additionally, in the printer controller 111 and the print engine 112 that are configured in this manner, the printer controller 111 and a driving circuit (not illustrated in the drawings), which includes a latch 132 that selectively inputs a driving signal having a predetermined waveform, which is output from the driving signal generation circuit 119, to the piezoelectric actuators 300, a level shifter 133 and a switch 134, correspond to a driving unit that applies a predetermined driving signal to the piezoelectric actuators 300.

Additionally, a shift register 131, the latch 132, the level shifter 133, the switch 134 and the piezoelectric actuator 300 are respectively provided for each nozzle opening 21 of the ink jet type recording head II, and the shift register 131, the latch 132, the level shifter 133 and the switch 134 generate a driving pulse from a discharge driving signal, a relief driving signal, and the like, that the driving signal generation circuit 119 generates. In this instance, the term driving pulse refers to an application pulse that is applied to the piezoelectric actuators 300 in a practical sense.

In such an ink jet type recording head II, firstly, print character data (SI) that configures dot pattern data is sequentially set by being transmitted in serial to the shift registers 131 from the output buffer 123 in synchronization with a clock signal (CK) from the oscillation circuit 117. In this case, firstly, data of a highest bit in the print character data of all of the nozzle openings 21 is transmitted in serial, and once the serial transmission of the data of the highest bit is finished, data of a second highest bit is transmitted in serial. Data of a lower bits is sequentially transmitted in serial in the same manner.

Further, once print character data of the corresponding bits are set in each shift register 131 for all of the nozzles, the control section 116 outputs a latch signal (LAT) to the latch 132 at a predetermined timing. The latch 132 latches print character data that is set in a shift register 131 as a result of the latch signal. The print character data (LATout) that the latch 132 latches is applied to the level shifter 133, which is a voltage amplifier. For example, in a case in which the print character data is "1", the level shifter 133 boosts the voltage up to a voltage value that can be driven by the switch 134, for example, a few tens of volts. Further, the boosted print character data is applied to each switch 134, and each switch 134 attains a connected state due to the corresponding print character data.

Further, a driving signal (COM), that the driving signal generation circuit 119 generates, is also applied to each switch 134, and when the switches 134 selectively attain a connected state, a driving signal is selectively applied to the piezoelectric actuators 300 that are connected to the switches 134. In this manner, in the ink jet type recording head II that is illustrated by way of example, it is possible to control whether or not a discharge driving signal is applied to the piezoelectric actuators 300 using print character data. For example, in a period in which the print character data is "1", since the switch 134 attains a connected state due to the latch signal (LAT), it is possible to supply a driving signal (COMout) to a piezoelectric element 18, and the piezoelectric element 18 is displaced (deformed) by the supplied driving signal (COMout). In addition, in a period in which the print character data is "0", since the switch 134 is not in a connected state, the supply of the driving signal to a piezoelectric actuator 300 is blocked. Additionally, in a period in which the print character data is "0", since each piezoelectric actuator 300 retains an immediately preceding potential, an immediately preceding displacement state is maintained.

In addition, a detection unit 210 that detects discharge faults of ink droplets from the nozzle openings 21, is provided in an ink jet type recording apparatus I of the present embodiment.

For example, as the detection unit 210, for example, it is possible to use an optical sensor such as a scanner that causes the ink jet type recording apparatus I to print a test pattern, and detects discharge faults (dot omission) by reading a printed pattern as an image. In addition, for example, a method that detects discharge faults on the basis of the amplitude of a potential signal by charging ink through the application of a voltage between a detection region, which is formed from a liquid absorbent body, and the nozzle plate 20 (the nozzle openings 21), and outputting a potential signal which represents a change in potential between the detection region and the nozzle plate 20 as a result of discharging charged ink as ink droplets, may be used as the detection unit 210. Furthermore, as the detection unit 210, a unit that detects an excessive voltage (an electromotive voltage) that is generated in the piezoelectric actuators 300 after the piezoelectric actuators 300 are driven, and detects discharge faults from the state of vibrations (residual vibrations), for example, the period length, amplitude, or the like of residual vibrations. Naturally, the detection unit is not limited to the above-mentioned configurations, and can use a unit that is well known from the related art.

A method that can be performed substantially simultaneously with printing during printing is preferable as the detection unit 210, and a method that detects discharge faults by detecting an excessive voltage that is generated in the piezoelectric actuators 300 and monitoring the residual vibrations thereof is particularly preferable, and therefore, such a method is adopted in the present embodiment. Additionally, a detection and determination technique of discharge faults using residual vibrations may use the technique that is disclosed in detail in Japanese Patent No. 3794431, may be used.

In addition, in addition to a printing control unit 201 that creates the above-mentioned printing data, a switching unit 220 is provided in the control section 116. The switching unit 220 is a unit that controls the printing control unit 201 in a manner in which a printing operation, which the printing control unit 201 is caused to perform, switches between a normal mode and a discharge prohibition mode on the basis of a detection result of the detection unit 210.

In this instance, the normal mode is normal printing that is executed when the detection unit 210 does not detect a discharge fault (dot omission), and executes printing so that a region of a recording sheet S of an extent that is equivalent to a single dot is filled in by an ink droplet that is discharged from a nozzle opening 21 that corresponds to a single pressure generation chamber 12 by driving a piezoelectric actuator 300 that corresponds to the single pressure generation chamber 12 on the basis of the printing signal.

In contrast to this, the discharge prohibition mode is printing that is executed when the detection unit 210 detects a discharge fault (dot omission), and is a mode that prohibits subsequent driving of a piezoelectric actuator 300 that corresponds to a nozzle opening 21 in which a discharge fault occurred without exception in a case in which a discharge fault occurs during printing. In this instance, prohibiting driving of a piezoelectric actuator 300 without exception refers to prohibiting both driving for discharge based on printing data and also driving for a flushing operation, driving for a micro vibration operation that applies micro vibrations for the prevention of ink thickening without discharging, and the like, without exception for a nozzle opening 21 in which a discharge fault occurred, and continues until a restoration operation such as a suction restoration operation, is performed.

The discharge prohibition mode is a mode that prevents further deterioration of a discharge fault, for example, a circumstance in which a state in which restoration is not possible is reached, by prohibiting driving of a piezoelectric actuator 300 that corresponds to a nozzle opening 21 in which a discharge fault occurred without exception. If driving for a discharge operation, driving for a micro vibration operation, and the like, are continued in a piezoelectric actuator 300 that corresponds to a nozzle opening 21 in which a discharge fault occurred, thickened ink that is present in the vicinity of the opening of the nozzle opening 21 is stirred and moves inward, and when this continues over a long period of time, a state in which the thickened state progresses to an inner portion is reached, and since there is a possibility that restoration will not be possible, such a state should be prevented. When the discharge prohibition mode is executed, since a piezoelectric actuator 300 that corresponds to a nozzle opening 21 is not driven at all, thickened ink in the vicinity of the of the opening of the nozzle opening 21 remains without change, a circumstance in which thickening progresses inward due to formation of a film is prevented even if a long period of time passes, and therefore, it is possible to retain a state in which it is easy to perform restoration with the next restoration operation.

In principle, printing is also continued in the discharge prohibition mode, but in a case in which a number of nozzle openings 21 in which a faulty discharge is detected is significantly large, or the like, printing may be postponed and may transition to restoration process immediately.

In addition, in a case in which printing is continued in the discharge prohibition mode, since the driving of a piezoelectric actuator 300 that corresponds to a nozzle opening 21 in which a discharge fault was detected, is prohibited, printing using nozzle openings 21 other than this is continued. Additionally, the prohibition of the driving of a piezoelectric actuator 300 that corresponds to a nozzle opening 21 in which a discharge fault was detected can be easily performed by cutting a driving signal to corresponding piezoelectric actuator 300. For example, a configuration in which switching to a connected state of the switch 134 that corresponds to a piezoelectric actuator 300 in which a discharge fault was detected, is prohibited, may be used.

Furthermore, in a case in which printing is continued in the discharge prohibition mode, supplemented printing that continues recording using recording data in which discharge from a nozzle opening 21 in which a discharge fault is detected is supplemented by discharge from another nozzle opening 21, may be executed.

Such supplemented printing may use a technique that is publicly known from the related art, but it is necessary to implement such a technique by disconnecting driving data of a piezoelectric actuator 300 that corresponds to a nozzle opening 21 in which a discharge fault occurred without exception.

Figure 6:
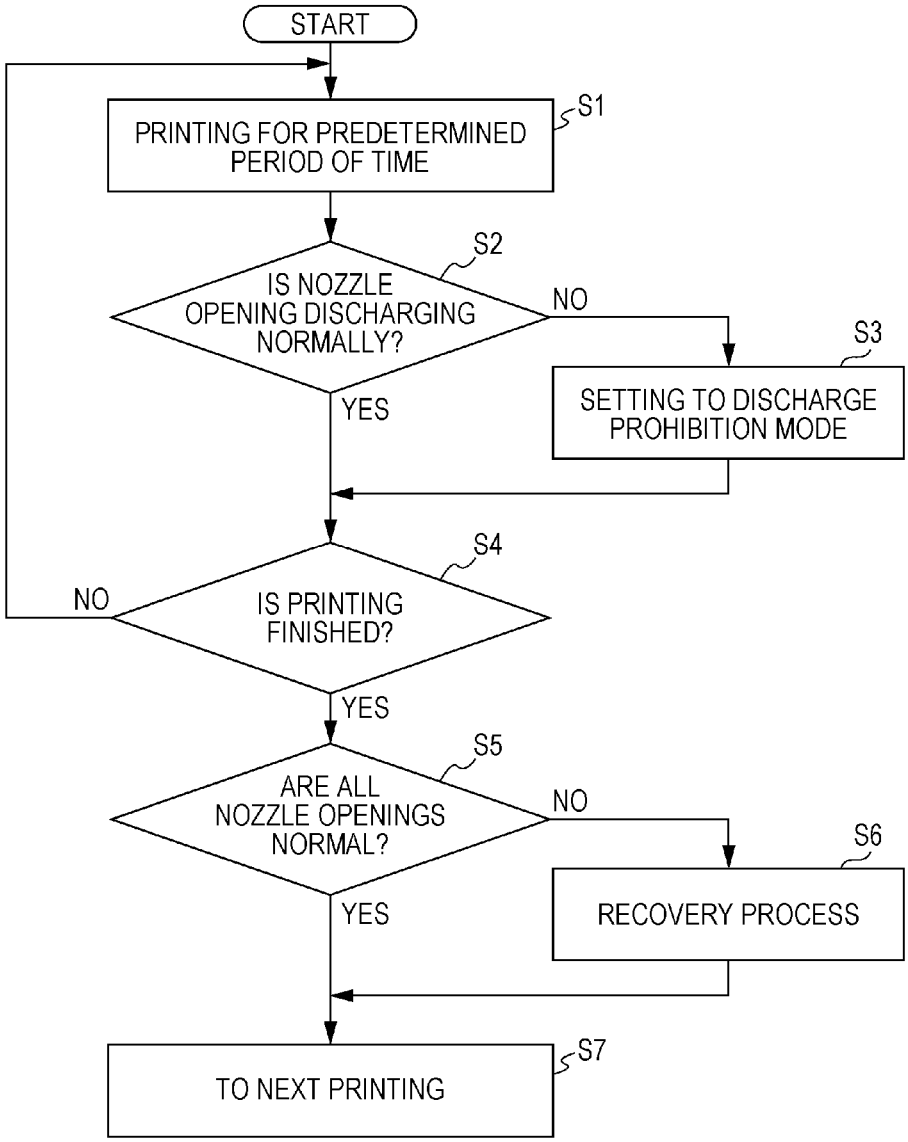
FIG. 6 is a flowchart that shows operations of the recording apparatus according to Embodiment 1 of the invention.

A switching operation between printing with the normal mode and printing with the discharge prohibition mode will be described with reference to the flowchart of FIG. 6.

After printing is performed for a predetermined time in Step S1, it is determined whether or not the nozzle openings are performing normal discharge in Step S2. In a case in which instead of normal discharge being performed by all of the nozzle openings, there is a nozzle opening with a discharge fault (Step S2, No), setting to the discharge prohibition mode is performed in Step S3, and in a case in which normal discharge is being performed by all of the nozzle openings (Step S2, Yes), the process transitions to Step S4 without change. In Step S4, it is determined whether or not printing is finished, and in a case in which printing is not finished (Step S4, No), the process returns to Step S1 and printing is continued. At this time, in a case of setting to the discharge prohibition mode in Step S3, printing is continued with the discharge prohibition mode, and in a case of not setting to the discharge prohibition mode in Step S3, printing is continued with the normal mode. Further, in a case in which it is determined that printing is finished in Step S4 (Step S4, Yes), it is determined whether or not all of the nozzle openings are normal in Step S5, and in a case in which there is a nozzle opening with a discharge fault (Step S5, No), a restoration process is executed in Step S6, and thereafter, the process transitions to a subsequent print (Step S7). At this time, even if there is a nozzle opening with a discharge fault while printing is underway, and printing is continued thereafter, since printing is continued with the discharge prohibition mode from a point at which the discharge fault occurs onwards, it is possible to reliably restore a nozzle opening with a discharge fault in the restoration process of Step S6 since subsequent driving of the nozzle opening is prohibited without exception. Additionally, in a case in which all of the nozzle openings are normal in Step S5 (Step S5, Yes), the process transitions to a subsequent print without change (Step S7).

In the embodiment that is described above, in a case in which a discharge fault is detected while printing is underway, since printing continues by prohibiting driving of a piezoelectric actuator 300 that corresponds to a nozzle opening with a discharge fault without exception, it is possible to avoid printing failure, and it is possible to reliably restore a nozzle opening in which a discharge fault occurred using a restoration process after printing is finished while preventing a circumstance in which the discharge fault is worsened further.

Embodiment 2

Figure 7:
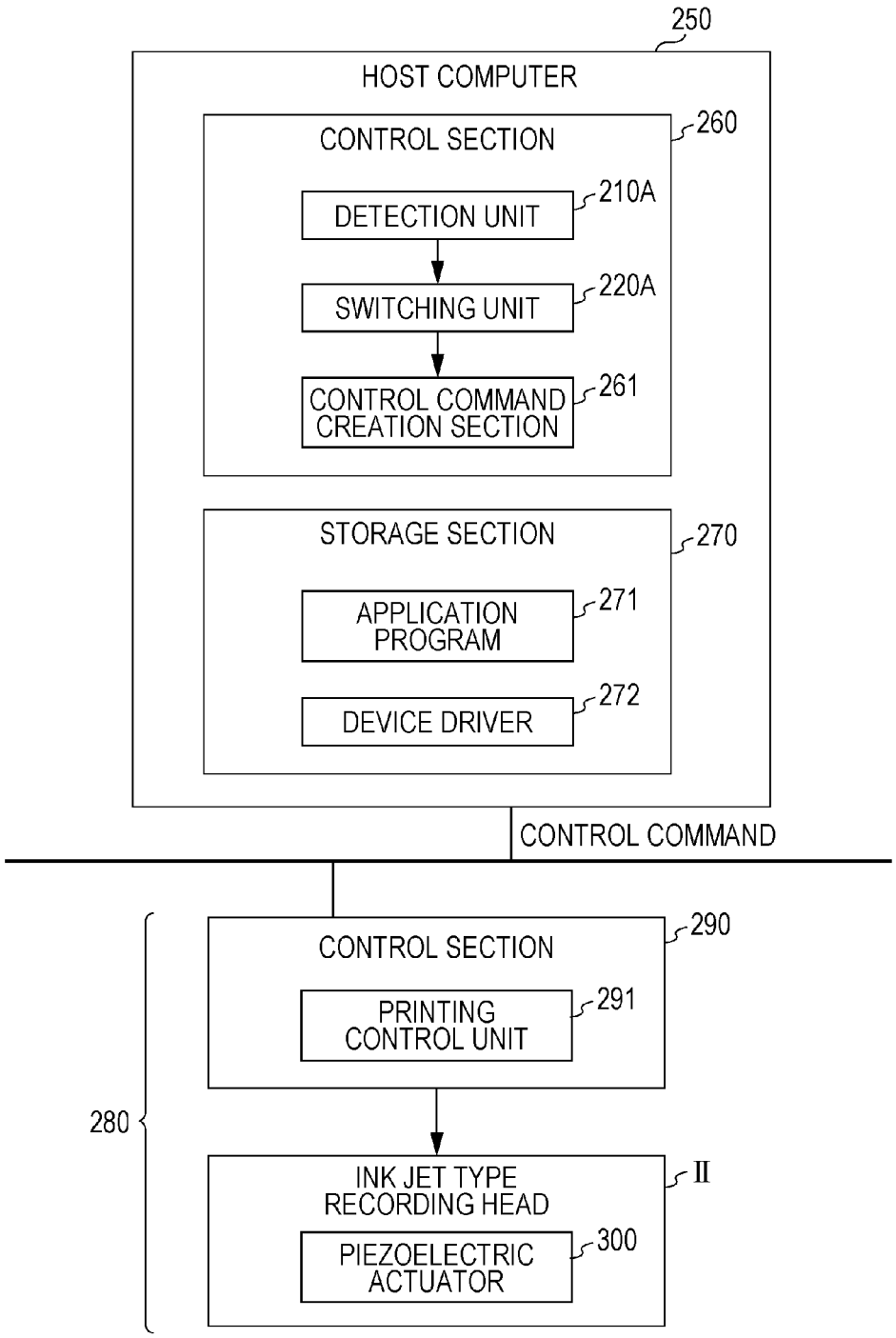
FIG. 7 is a schematic configuration diagram of a recording system according to Embodiment 2 of the invention.

In FIG. 7, a schematic configuration of a recording system that is formed from a host computer, which is a control device, and a recording apparatus that is connected to the host computer, is illustrated.

As shown in FIG. 7, a host computer 250 is provided with a host side control section 260 and a storage section 270.

The control section 260 is provided with a CPU, ROM, RAM, and other peripheral circuits, is a component that controls each section of the host computer 250 in a centralized manner, and includes a control command generation section 261. In addition, the storage section 270 is provided with memory that stores various data in a non-volatile manner, and at least an application program 271 and a device driver 272 are stored therein.

The application program 271 generates information related to recording data at a time of recording by a recording apparatus 280, and outputs the information to the device driver 272.

In addition, the device driver 272 is a program for controlling the recording apparatus 280. When information of recording data is input from the application program 271, the device driver 272 generates a control command, and outputs the control command to the recording apparatus 280. The recording apparatus 280 executes recording on the basis of the control command.

The recording apparatus 280 is provided with an ink jet head (a recording head) that is capable of color printing, and a recording unit having a transport mechanism that transports set label paper sheets, is a recording apparatus that executes recording using the recording head, and other than not including the detection unit 210 and the switching unit 220, has the structure that is described in Embodiment 1.

The recording apparatus 280 includes a printer side control section 290, and a similar ink jet type recording head II to that of Embodiment 1.

The control section 290 includes a CPU, ROM, RAM, and the like, and controls each section of the recording apparatus 280 in a centralized manner. The printer side control section 290 is provided with a printing control unit 291 that causes the ink jet type recording head II to execute recording by interpreting a control command in a case in which a control command is received from the host computer 250.

In the present embodiment, the host side control section 260 includes a detection unit 210A and a switching unit 220A. The detection unit 210A and the switching unit 220A TAG will be described briefly since the configurations thereof are fundamentally the same as the components of Embodiment 1.

The detection unit 210A is a unit that detects discharge faults of ink droplets from the nozzle opening 21, and more specifically, is a unit that detects an excessive voltage (an electromotive voltage) that is generated in the piezoelectric actuators 300 after the piezoelectric actuators 300 are driven, and detects discharge faults from the state of vibrations (residual vibrations), for example, the period length, amplitude, or the like of residual vibrations.

In addition, the switching unit 220A is a unit that switches a control command, which the control command generation section 261 generates, between a control command for a normal mode and a control command for a discharge prohibition mode on the basis of a detection result of the detection unit 210A.

In this instance, the normal mode is normal printing that is executed when the detection unit 210A does not detect a discharge fault (dot omission), and creates a control command that executes printing so that a region of a recording sheet S of an extent that is equivalent to a single dot is filled in by an ink droplet that is discharged from a nozzle opening 21 that corresponds to a single pressure generation chamber 12 by driving a piezoelectric actuator 300 that corresponds to the single pressure generation chamber 12 on the basis of the printing signal.

In contrast to this, the discharge prohibition mode is printing that is executed when the detection unit 210A detects a discharge fault (dot omission), and is a mode that prohibits subsequent driving of a piezoelectric actuator 300 that corresponds to a nozzle opening 21 in which a discharge fault occurred without exception in a case in which a discharge fault occurs during printing. In this instance, prohibiting driving of a piezoelectric actuator 300 without exception refers to prohibiting both driving for discharge based on printing data and also driving for a flushing operation, driving for a micro vibration operation that applies micro vibrations for the prevention of ink thickening without discharging, and the like, without exception for a nozzle opening 21 in which a discharge fault occurred, and continues until a restoration operation such as a suction restoration operation, is performed.

In principle, printing is also continued in the discharge prohibition mode, but in a case in which a number of nozzle openings 21 in which a faulty discharge is detected is significantly large, or the like, printing may be postponed and may transition to restoration process immediately.

Further, the control command of a case in which printing is continued in the discharge prohibition mode, is a control command that prohibits driving of a piezoelectric actuator 300 that corresponds to a nozzle opening 21 in which a discharge fault was detected, and continues printing using nozzle openings 21 other than this.

In the present embodiment, in a case in which a nozzle opening 21 with a discharge fault is detected as a result of a nozzle opening 21 with a discharge fault being detected on the host computer 250 side, since the control command for the discharge prohibition mode is transmitted to the recording apparatus 280, a circumstance in which a state in which restoration is not possible, is reached, is prevented while preventing a circumstance in which the discharge fault is worsened further.

In addition, in the abovementioned manner, a program that causes the control section 260 to function as the detection unit 210A and the switching unit 220A may be executed in order to provide a detection unit 210A and a switching unit 220A such as those mentioned above in the control section 260 of the host computer 250.

In the embodiment that is described above, in a case in which a discharge fault is detected while printing is underway, since printing continues by prohibiting driving of a piezoelectric actuator 300 that corresponds to a nozzle opening with a discharge fault without exception, it is also possible to avoid printing failure, and it is possible to reliably restore a nozzle opening in which a discharge fault occurred using a restoration process after printing is finished while preventing a circumstance in which the discharge fault is worsened further.

Other Embodiments

An embodiment of the invention is described above, but the basic configuration of the invention is not limited to the configurations mentioned above.

In Embodiment 1 mentioned above, an example in which a single nozzle opening 21 is provided for a single pressure generation chamber 12 is illustrated by way of example, but the invention is not particularly limited to this configuration, and two or more nozzle openings may be provided for a single pressure generation chamber 12. Even in a case in which there are a plurality of nozzle openings for a single pressure generation chamber, a configuration in which a nozzle group is configured by a plurality of nozzle openings 21 may be used by treating the plurality of nozzle openings that are in communication with a single pressure generation chamber as a single nozzle opening 21.

Furthermore, in Embodiment 1 mentioned above, description was given using the piezoelectric actuators 300, which include the thin film type piezoelectric body layer 70, as the pressure generation chambers that generate pressure changes in the pressure generation chambers 12, but the invention is not particularly limited to this configuration, and for example, it is possible to use a piezoelectric actuator that has a thick film type piezoelectric body layer, which is formed using a method such as pasting of a green sheet, a longitudinal vibration type piezoelectric actuator in which that expands and contracts in an axial direction as a result of a piezoelectric material and an electrode forming material being alternately laminated, or the like. In addition, as the pressure generation unit, it is possible to use a unit in which a heat-emitting element is disposed inside the pressure generation chambers and that discharges liquid droplets from nozzle openings using a bubble that is created due to heat build-up of the heat-emitting element, a so-called electrostatic actuator that generates static electricity between a vibration plate and an electrode, and discharges liquid droplets from nozzle openings by deforming the vibration plate due to an electrostatic force, or the like.

In addition, in the above-mentioned example, the ink jet type recording apparatus I has a configuration in which the ink cartridge 2 is mounted in the carriage 3, but the invention is not particularly limited to this configuration, and for example, a liquid accumulation unit such as an ink tank may be fixed to the apparatus main body 4, and the accumulation unit and the ink jet type recording head II may be connected via a supply pipe such as a tube. In addition, a liquid accumulation unit need not be mounted on the ink jet type recording apparatus.

Additionally, in the above-mentioned embodiments, description is given using an ink jet type recording head as an example of a liquid ejecting head and an ink jet type recording apparatus as an example of a liquid ejecting apparatus, but the invention was devised for all liquid ejecting apparatuses that are provided with a wide range of liquid ejecting heads, and naturally, can also be applied to liquid ejecting apparatuses that eject liquids other than ink. Examples of such other liquid ejecting apparatuses include various recording heads that are used in image recording apparatuses such as printers, color material ejecting heads that are used in the manufacture of color filters such as liquid crystal displays, electrode material ejecting heads that are used in electrode formation such as organic EL displays, Field Emission Displays (FED) and the like, living organic material ejecting heads that are used in the production of biochips and the like, and it is possible to apply the invention to liquid ejecting apparatuses that are provided with such liquid ejecting heads.

The entire disclosure of Japanese Patent Application No. 2015-168280, filed Aug. 27, 2015 is expressly incorporated by reference herein in its entirety.

What is claimed is:

1. A liquid ejecting apparatus for recording on a recording medium, the liquid ejecting apparatus comprising:

a liquid ejecting head comprising:

a plurality of nozzle openings configured to discharge a liquid, a plurality of pressure generation chambers that are in communications with the plurality of nozzle openings, and a plurality of pressure generation units configured to generate pressure changes in the pressure generation chambers;

a detection unit configured to detect a discharge fault of a liquid droplet of the liquid ejecting head for each of the nozzle openings; and a control unit configured to control the pressure generation units, wherein the control unit is configured such that, when the discharge fault is detected for one or more of the nozzle openings while recording is underway, the control unit operates in a discharge prohibition mode, in which (i) the control unit prevents driving of one or more pressure generation units corresponding to the one or more nozzle openings for which the discharge fault is detected, and (ii) while the control unit prevents driving of one or more pressure generation units corresponding to the one or more nozzle openings for which the discharge fault is detected, the control unit causes the liquid ejecting apparatus to continue recording using nozzle openings other than the one or more nozzle openings for which the discharge fault is detected.

2. The liquid ejecting apparatus according to claim 1, wherein, when the control unit operates in the discharge prohibition mode, the control unit causes the liquid ejecting apparatus to continue recording using recording data in which discharge from the one or more nozzle openings for which the discharge fault is detected is supplemented by discharge from one or more other nozzle openings.

3. The liquid ejecting apparatus according to claim 1, wherein the detection unit is configured to detect an excessive voltage that is generated in the pressure generation units after the pressure generation units are driven, and to detect the discharge fault using a vibration state of the pressure generation units.

4. A control device configured to be connected to a liquid ejecting apparatus comprising a liquid ejecting head that comprises a plurality of nozzle openings configured to discharge a liquid, a plurality of pressure generation chambers that are in communications with the plurality of nozzle openings, and a plurality of pressure generation units configured to generate pressure changes in the pressure generation chambers, the control device comprising:

a controller configured to:

transmit a control command that includes information that causes the liquid ejecting apparatus to execute recording, and detect a discharge fault of liquid droplets of the liquid ejecting head of the liquid ejecting apparatus for each of the nozzle openings, wherein the controller is configured such that, when the discharge fault is detected for one or more of the nozzle openings while recording is underway, the controller operates in a discharge prohibition mode, in which (i) the controller prevents driving of one or more pressure generation units corresponding to the one or more nozzle openings for which the discharge fault is detected, and (ii) while the controller prevents driving of one or more pressure generation units corresponding to the one or more nozzle openings for which the discharge fault is detected, the controller causes the liquid ejecting apparatus to continue recording using nozzle openings other than the one or more nozzle openings for which the discharge fault is detected.

5. The control device according to claim 4, wherein, when the controller operates in the discharge prohibition mode, the controller causes the liquid ejecting apparatus to continue recording using recording data in which discharge from the one or more nozzle openings for which the discharge fault is detected is supplemented by discharge from one or more other nozzle openings.

6. A recording system comprising:

the control device according to claim 5; and said liquid ejecting apparatus.

7. The control device according to claim 4, wherein the controller is configured to detect an excessive voltage that is generated in the pressure generation units after the pressure generation units are driven, and to detect the discharge fault using a vibration state of the pressure generation units.

8. A recording system comprising:

the control device according to claim 7; and said liquid ejecting apparatus.

9. A recording system comprising:

the control device according to claim 4; and said liquid ejecting apparatus.

10. A non-transient computer readable medium for controlling a controller connected to a liquid ejecting apparatus comprising a liquid ejecting head that comprises a plurality of nozzle openings configured to discharge a liquid, a plurality of pressure generation chambers that are in communications with the plurality of nozzle openings, and a plurality of pressure generation units configured to generate pressure changes in the pressure generation chambers, the non-transient computer readable medium comprising a program for causing the controller to perform steps of:

transmitting a control command that includes information that causes the liquid ejecting apparatus to execute recording;

detecting a discharge fault of liquid droplets of the liquid ejecting head of the liquid ejecting apparatus for each of the nozzle openings; and when the discharge fault is detected for one or more of the nozzle openings while recording is underway, operating in a discharge prohibition mode, in which (i) the controller prevents driving of one or more pressure generation units corresponding to the one or more nozzle openings for which the discharge fault is detected, and (ii) while the controller prevents driving of one or more pressure generation units corresponding to the one or more nozzle openings for which the discharge fault is detected, the controller causes the liquid ejecting apparatus to continue recording using nozzle openings other than the one or more nozzle openings for which the discharge fault is detected.

* * * * *